US008308240B1

(12) United States Patent
Chou et al.

(10) Patent No.: US 8,308,240 B1
(45) Date of Patent: Nov. 13, 2012

(54) ADJUSTABLE LUMBAR SUPPORT ASSEMBLY FOR A CHAIR

(76) Inventors: Kuo-Ching Chou, Tainan (TW); Ding-Kuo Chou, Tainan (TW)

( * ) Notice: Subject to any disclaimer, the term of this patent is extended or adjusted under 35 U.S.C. 154(b) by 26 days.

(21) Appl. No.: 13/174,833

(22) Filed: Jul. 1, 2011

(51) Int. Cl.
*A47C 7/46* (2006.01)

(52) U.S. Cl. ..... 297/284.4

(58) Field of Classification Search ..... 297/284.4, 297/284.1
See application file for complete search history.

(56) References Cited

U.S. PATENT DOCUMENTS 4,182,533 A * 1/1980 Arndt et al. ..... 297/284.4
5,588,703 A * 12/1996 Itou ..... 297/284.4
7,334,841 B2 * 2/2008 Chou ..... 297/284.4
7,445,287 B2 * 11/2008 Chou ..... 297/284.4
* cited by examiner

*Primary Examiner* — Milton Nelson, Jr.
(74) *Attorney, Agent, or Firm* — Alan Kamrath; Kamrath IP Lawfirm, PA

(57) ABSTRACT

An adjustable lumbar support assembly for a chair includes a base, a lumbar support, and an angle adjustment assembly. The base is formed at a lower end of the backrest of the chair. Bar sections bilaterally formed at a lower end of the lumbar support are positioned across the base. The angle adjustment assembly is connected with one bar section of the lumbar support and the base. To tilt the lumbar support forward or backward, a pulling rod is pulled backward to bring the lumbar support into a free state where projections on corresponding surfaces of a positioning element and a moving element mounted around the pulling rod are pressed against each other to allow manual adjustment of the lumbar support for optimal support. When the pulling rod is pushed back, the lumbar support enters a locked state where the positioning element and the moving element are in projection-recess engagement.

5 Claims, 13 Drawing Sheets

ADJUSTABLE LUMBAR SUPPORT ASSEMBLY FOR A CHAIR

BACKGROUND OF THE INVENTION

1. Technical Field

The present invention relates to a lumbar support structure for a chair and, more particularly, to an adjustable lumbar support assembly wherein a lumbar support is provided on the front side of a chair and can be easily adjusted forward or backward for optimal support and sitting comfort.

2. Description of Related Art

Chairs featuring enhanced sitting comfort are typically provided with a flexible adjustment mechanism at the seat unit, the backrest unit, and/or other units. The adjustment mechanism is intended to allow sitters to make the desired adjustment for optimal sitting comfort.

BRIEF SUMMARY OF THE INVENTION

The present invention provides an improvement over existing lumbar supports that are located on the front side of chairs and are adjustable in position. It is desirable that the overall structure of such an adjustable lumbar support can be effectively simplified but remains adjustable by, for example tilting forward and backward.

The primary object of the present invention is to provide a lumbar support assembly disposed on the front side of a chair, wherein the lumbar support assembly includes a base, a lumbar support, and an angle adjustment assembly. The base is formed at a lower end of the backrest of the chair. A lower end of the lumbar support has left and right bar sections positioned across the base. The angle adjustment assembly is connected to the base and the bar section of the lumbar support that extends through one lateral portion of the lower end of the backrest. When it is desired to make forward or backward adjustment to the lumbar support assembly at the lower end of the backrest, a pulling rod is pulled backward to bring the lumbar support into a free state in which projections on corresponding surfaces of a positioning element and a moving element mounted around the pulling rod are pressed against each to allow manual adjustment of the lumbar support to the desired position. When the pulling rod is later pushed back to its original position, the lumbar support enters a locked state in which the projections and recesses on the corresponding surfaces of the positioning element and the moving element are engaged with each other. Thus, the lumbar support assembly can be easily adjusted forward and backward to provide optimal support and comfort.

The second object of the present invention is to provide the foregoing lumbar support assembly, wherein the pulling rod has a horizontal rod section, and at least one washer is mounted around the horizontal rod section and located between an outer washer and at least one engaging element so as to enable flexible adjustment of forward/backward rotation of the lumbar support assembly.

The third object of the present invention is to provide the foregoing lumbar support assembly, wherein the pulling rod has a threaded rod section formed with a flat surface on one side, the positioning element is mounted around the threaded rod section and has one end formed with a projection, and the moving element has a predetermined peripheral section formed with a bent portion extending toward the positioning element so as to limit the extent to which the pulling rod can be pivotally pulled backward.

The fourth object of the present invention is to provide the foregoing lumbar support assembly, wherein the base at the lower end of the backrest has a lateral side concavely provided with a through hole, and a cavity is formed on the lateral side along the rim of the through hole. The cavity provides a space in which the positioning element and the moving element mounted around the pulling rod can move when activated.

The fifth object of the present invention is to provide the foregoing lumbar support assembly, wherein the threaded rod section of the pulling rod that has a flat surface on one side is fastened with a screw nut, and the screw nut is internally provided with an anti-loosening washer such that all the engaging elements and rotating elements mounted around the horizontal rod section of the pulling rod are kept closely packed.

BRIEF DESCRIPTION OF THE SEVERAL VIEWS OF THE DRAWINGS

The structure as well as a preferred mode of use, further objects, and advantages of the present invention will be best understood by referring to the following detailed description of an illustrative embodiment in conjunction with the accompanying drawings, in which.

DETAILED DESCRIPTION OF THE INVENTION

Figure 1:
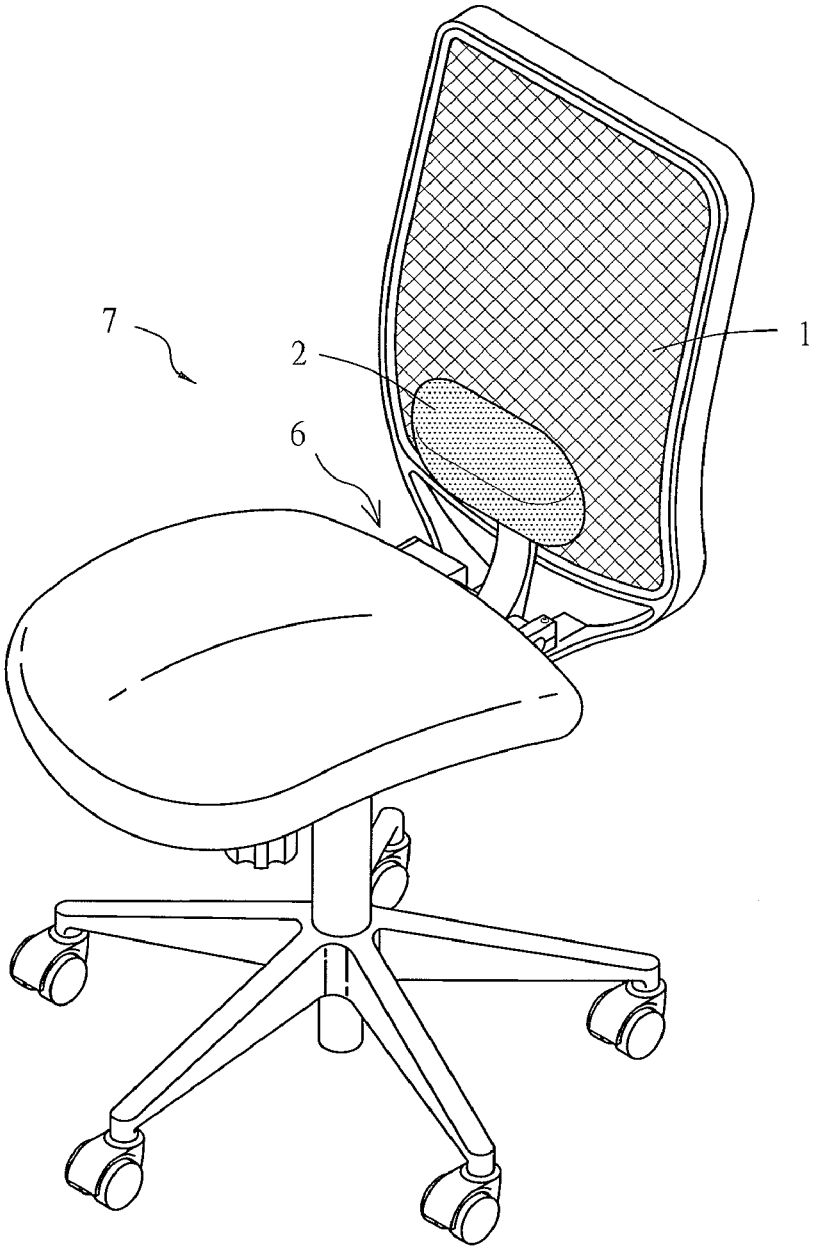
FIG. 1 is a perspective view of a chair provided with the lumbar support assembly according to the present invention.
Figure 3:
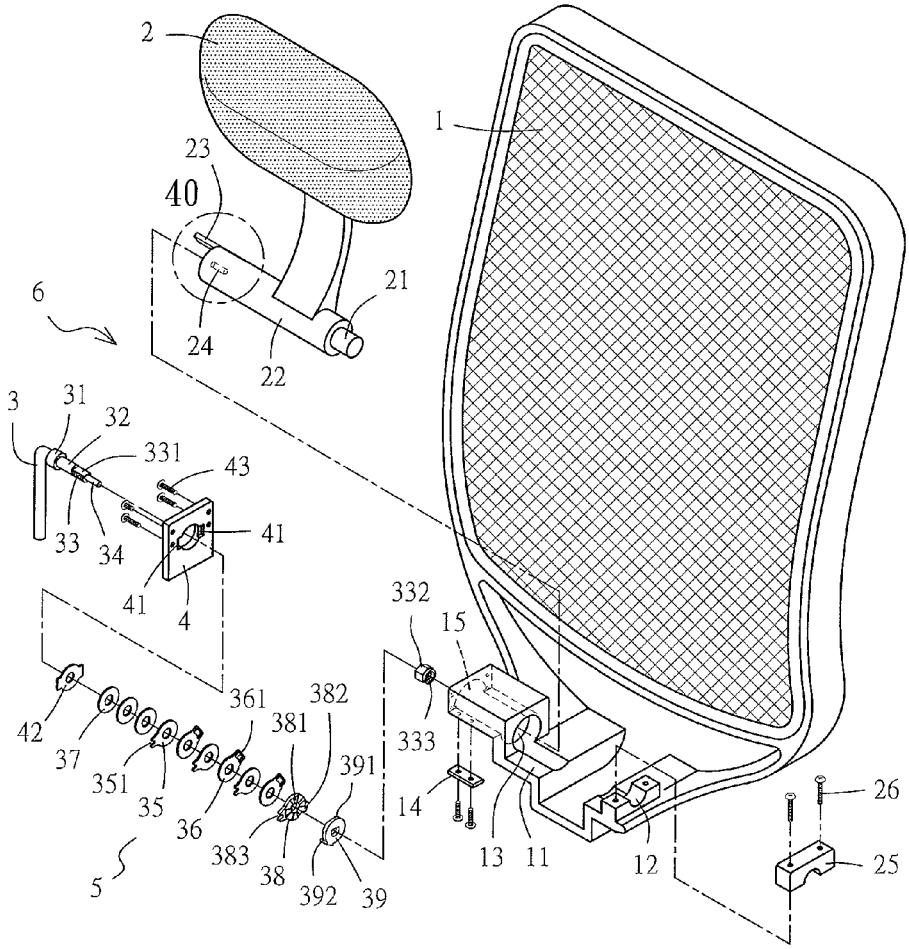
FIG. 3 is an exploded perspective view of the lumbar support assembly according to the present invention.

Referring to FIGS. 1 and 3, a lumbar support assembly 6 according to the present invention is provided on the front side of a chair 7 and includes a base 11 formed at a lower end of a backrest 1, a lumbar support 2, and an angle adjustment assembly 5.

Figure 2:
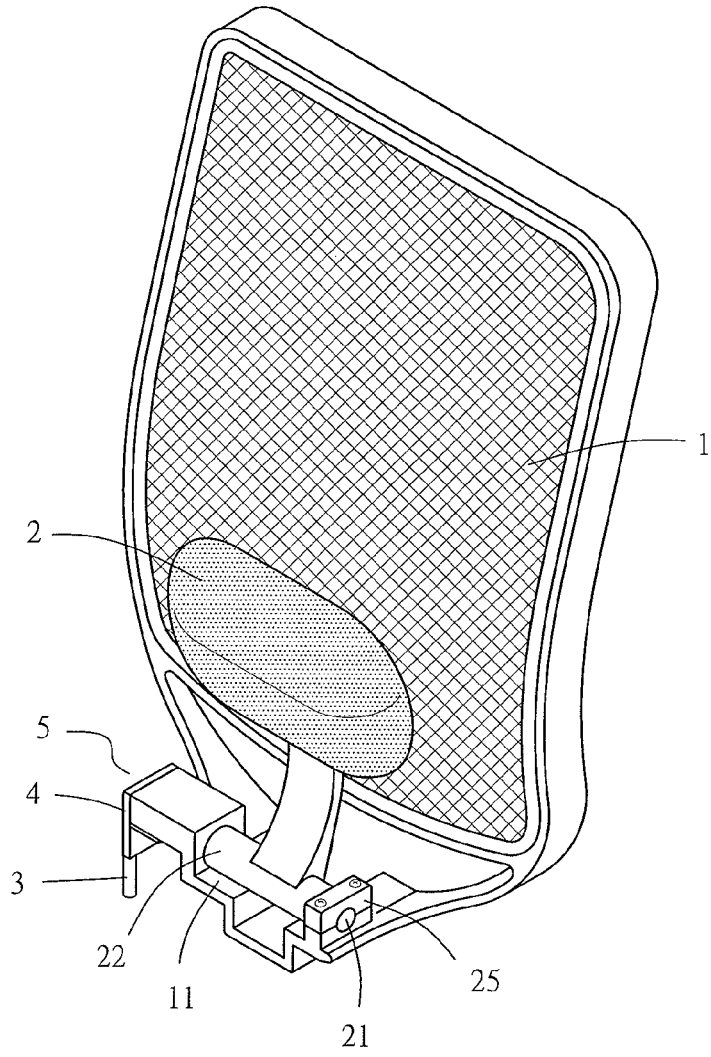
FIG. 2 is a perspective view of a backrest and the lumbar support assembly according to the present invention.

The base 11 has two spaced lateral portions formed respectively and concavely with a groove 12 and a through hole 13 (see FIG. 3). Left and right bar sections 22 and 21 formed at a lower end of the lumbar support 2 are placed in the through hole 13 and the groove 12 of the base 11 respectively (see FIG. 2). The bar section 22 at the lower end of the lumbar support 2 is extended with a control portion 23.

Figure 7:
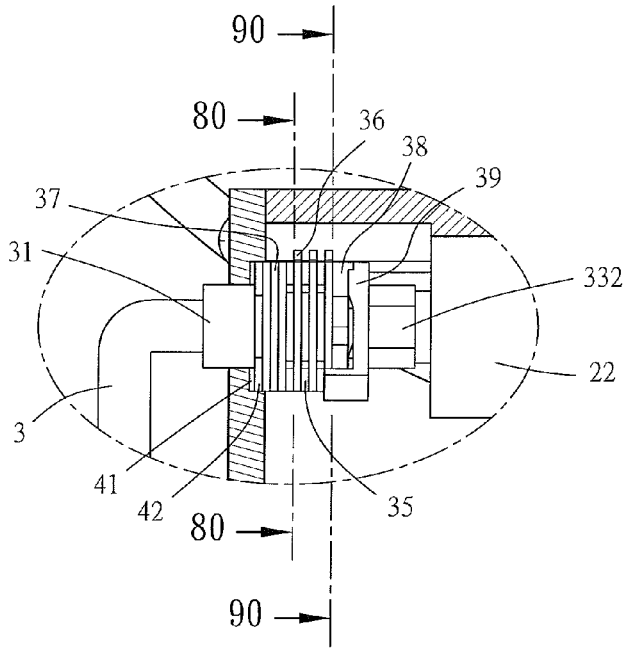
FIG. 7 is a detailed view of the circled area 70 in FIG. 6.
Figure 12:
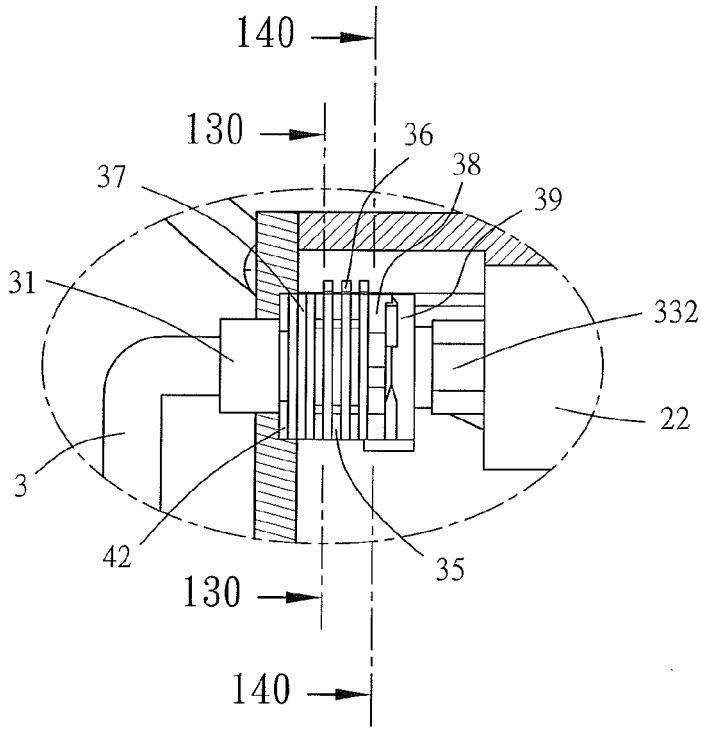
FIG. 12 is a detailed view of the circled area 120 in FIG. 11.

The angle adjustment assembly 5 includes a pulling rod 3. The pulling rod 3 has flange 31 configured to be inserted into a side panel 4 (see FIGS. 3 and 7). The inner surface of the side panel 4 is bilaterally provided with concave spaces 41 for receiving an outer washer 42. The pulling rod 3 further has a horizontal rod section 32 adjacent to the flange 31, and at least one engaging element 35 and at least one rotating element 36 are mounted around the horizontal rod section 32 in an alternate fashion. Besides, at least one washer 37 is mounted around the horizontal rod section 32 and is located between the outer washer 42 and the at least one engaging elements 35. The number of the at least one washer 37 may vary as needed so that forward/backward rotation of the lumbar support assembly 6 can be adjusted flexibly. The pulling rod 3 further has a threaded rod section 33 which is adjacent to the horizontal rod section 32 and which has a flat surface 331 on one side. Mounted around the threaded rod section 33 are a positioning element 38 and a moving element 39 (see FIGS. 3 and 7). The positioning element 38 has one surface formed with alternately arranged projections and recesses 381. Likewise, the corresponding surface of the moving element 39 is formed with alternately arranged projections and recesses 391. When the projections on one of the positioning element 38 and the moving element 39 are aligned and engaged with the recesses on the other of the positioning element 38 and the moving element 39 (see FIG. 7), the lumbar support 2 is in a locked state. When the projections on one of the positioning element 38 and the moving element 39 are aligned with and pressed against the projections on the other of the positioning element 38 and the moving element 39 (see FIG. 12), the lumbar support 2 is in a free state. A screw nut 332 is fastened to one distal end of the threaded rod section 33 and serves as a position limiting element (see FIGS. 3 and 7).

Figure 4:
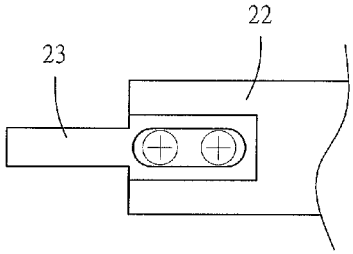
FIG. 4 is a detailed view of the circled area 40 in FIG. 3.
Figure 6:
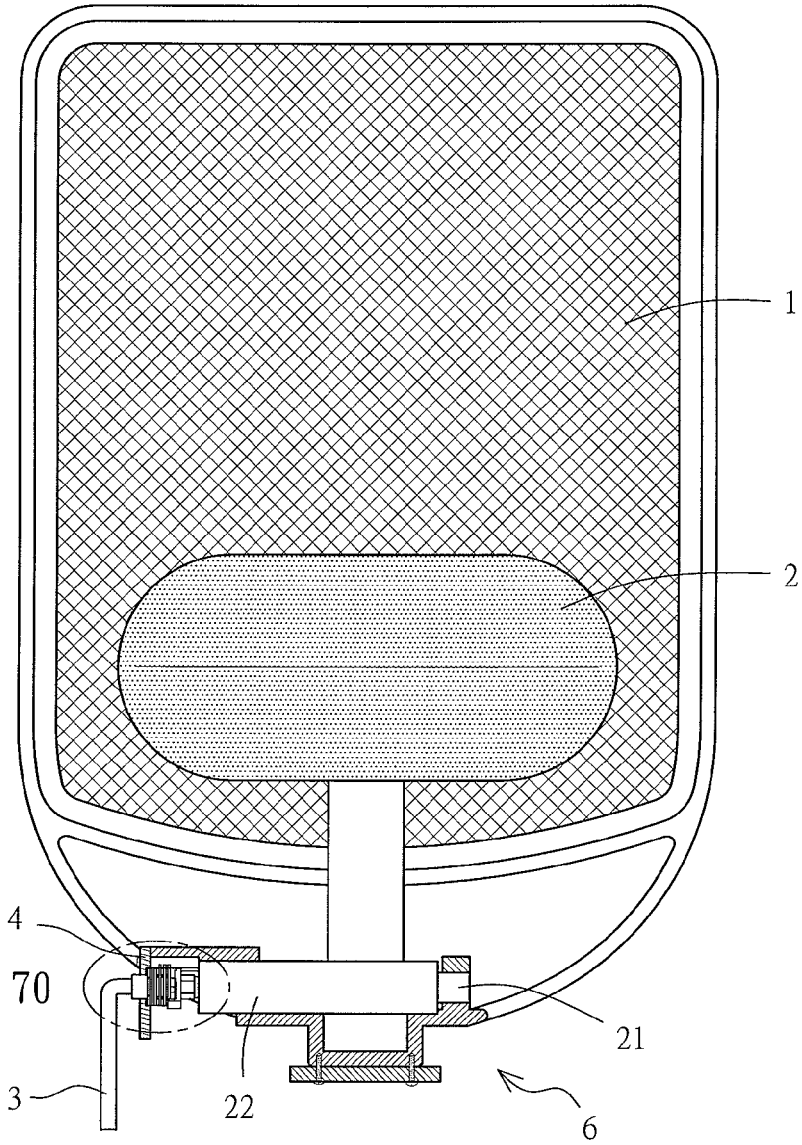
FIG. 6 is a partially sectional front view of the lumbar support assembly according to the present invention connected to a chair.
Figure 8:
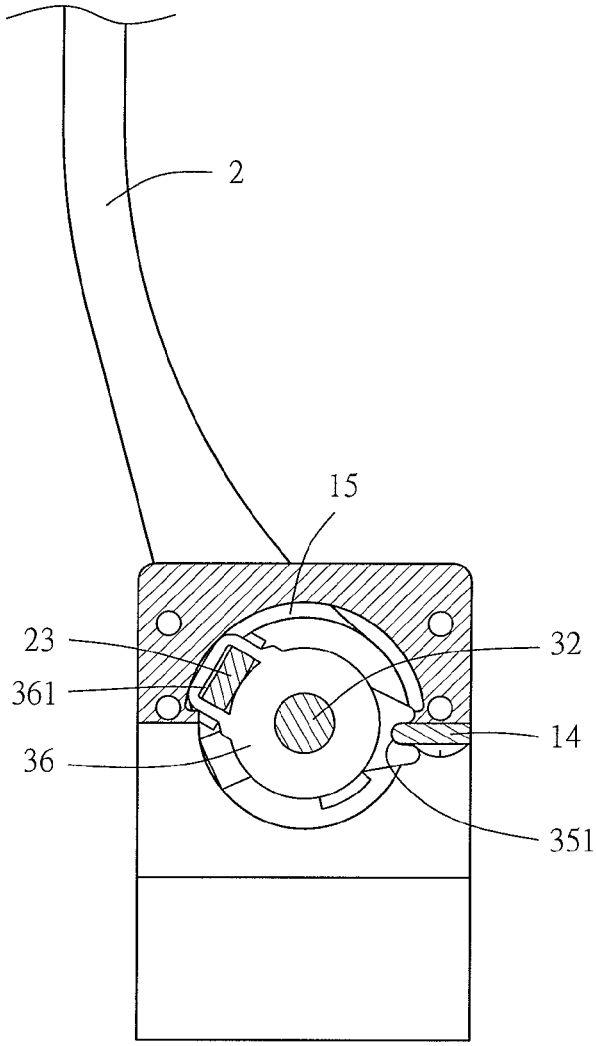
FIG. 8 is a sectional view taken along the line 80-80 in FIG. 7.

Each of the rotating elements 36 mounted around the pulling rod 3 has one end formed with a hole 361 through which the control portion 23 extending from the bar section 22 at the lower end of the lumbar support 2 passes (see FIGS. 3, 4, and 8). Each engaging element 35 has one end formed with a slot 351 with which a stopper plate 14 is engaged, wherein the stopper plate 14 is installed at the bottom of one lateral portion of the base 11. The aforesaid distal end of the threaded rod section 33 of the pulling rod 3 is extended with another rod section 34 configured to be inserted into a hole 24 in the corresponding bar section 22 of the lumbar support 2. The side panel 4 is located at a relatively outer position of the pulling rod 3, pressed against one lateral portion of the base 11 (see FIGS. 6 and 7), and fixed in position by a number of threaded fasteners 43. The bar section 21 at the lower end of the lumbar support 2 is covered with a covering element 25 (see FIGS. 3 and 6) and limited in position by threaded fasteners 26.

Figure 9:
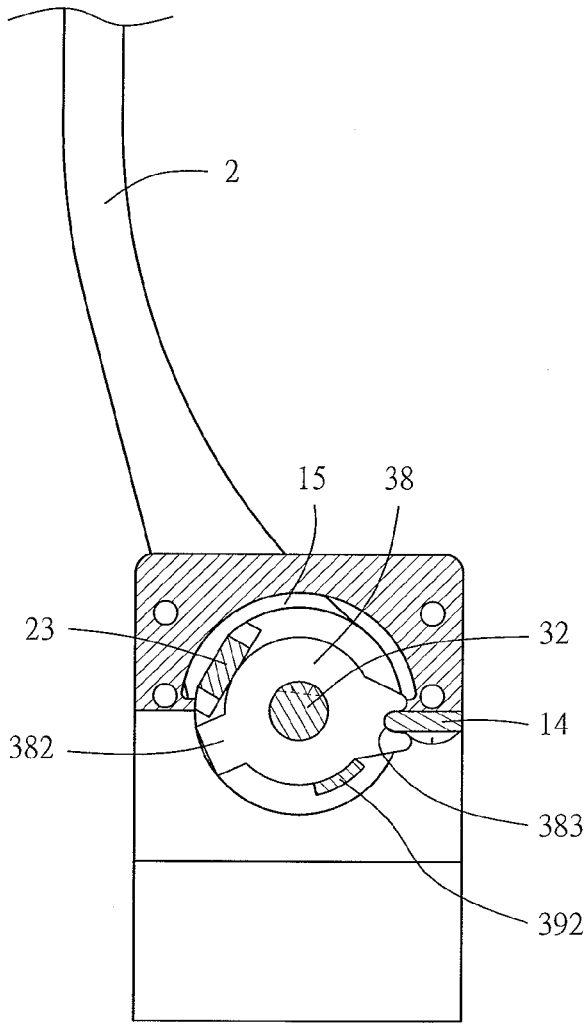
FIG. 9 is a sectional view taken along the line 90-90 in FIG. 7.

The positioning element 38 mounted around the threaded rod section 33 of the pulling rod 3 has one end formed with a projection 382 (see FIG. 3). Also, a predetermined peripheral part of the moving element 39 has a bent portion 392 extending toward the positioning element 38 so as to limit rotation of the pulling rod 3 when the pulling rod 3 is pulled backward (see FIG. 9).

Figure 13:
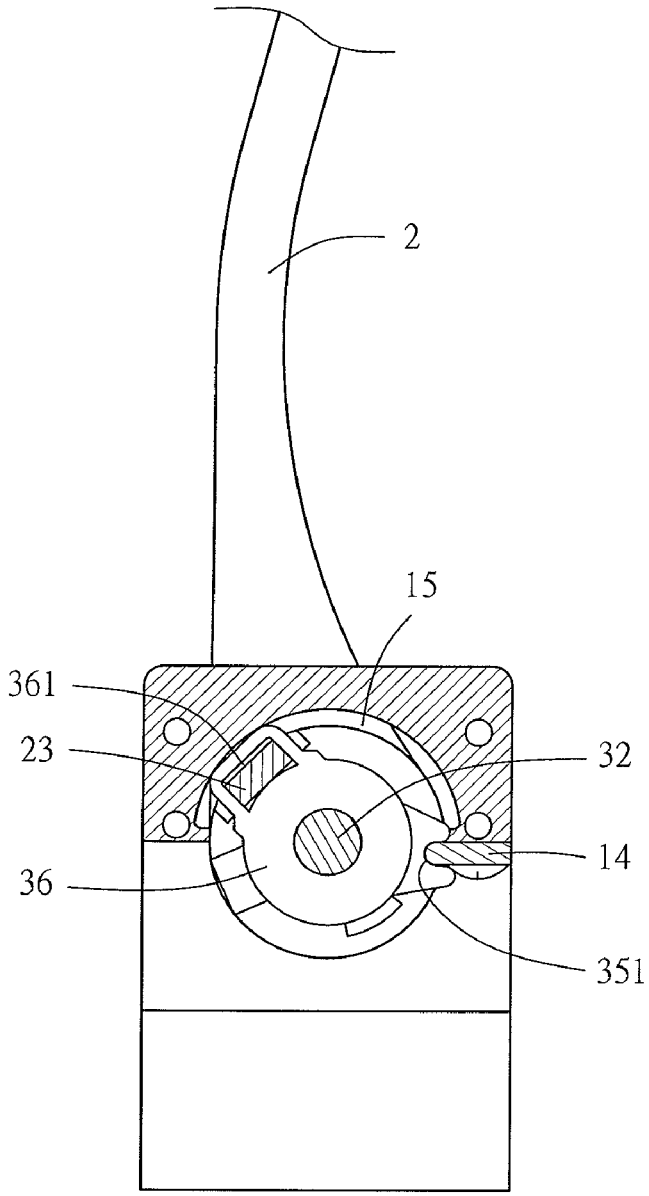
FIG. 13 is a sectional view taken along the line 130-130 in FIG. 12.

The base 11 at the lower end of the backrest 1 has a lateral side on which the through hole 13 is concavely provided and which is formed with a cavity 15 along the rim of the through hole 13 (see FIGS. 3 and 8). The cavity 15 provides a space in which the positioning element 38 and the moving element 39 mounted around the pulling rod 3 can move when activated (see FIG. 13).

The screw nut 332 fastened to the threaded rod section 33 of the pulling rod 3 is internally provided with an anti-loosening washer 333 (see FIG. 3) such that all the engaging elements 35 and rotating elements 36 mounted around the horizontal rod section 32 of the pulling rod 3 are kept closely packed.

Figure 5:
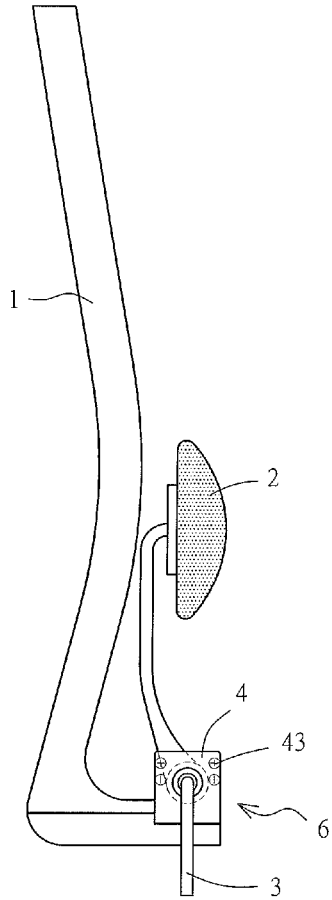
FIG. 5 is a side view of a backrest and the lumbar support assembly according to the present invention.
Figure 10:
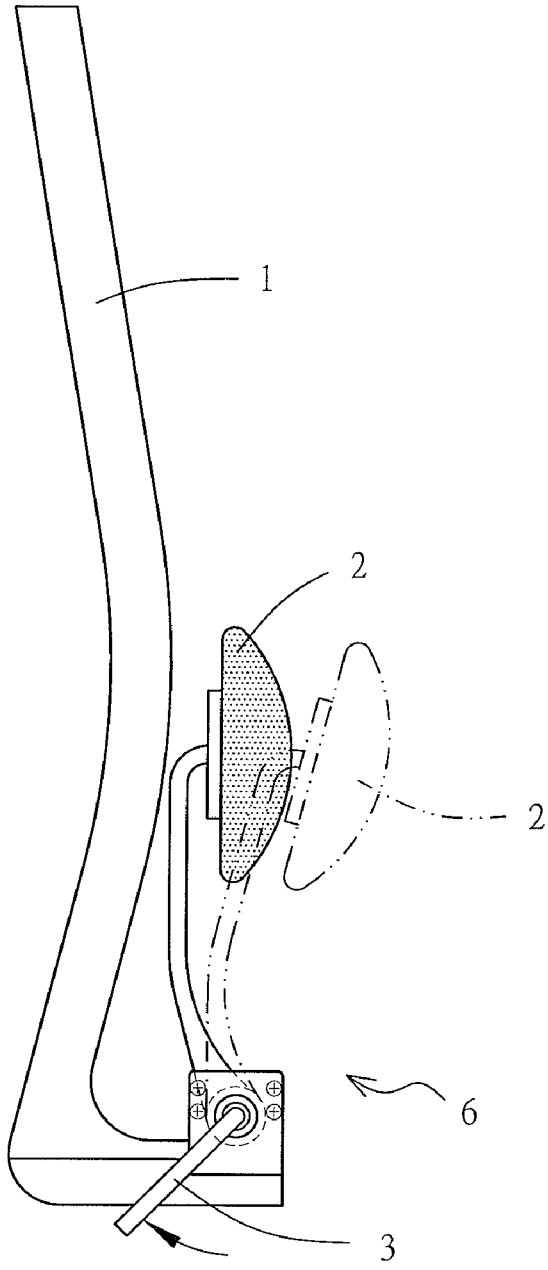
FIG. 10 is a side view showing the lumbar support assembly of the present invention before adjustment and after a pulling rod has been pulled backward.
Figure 11:
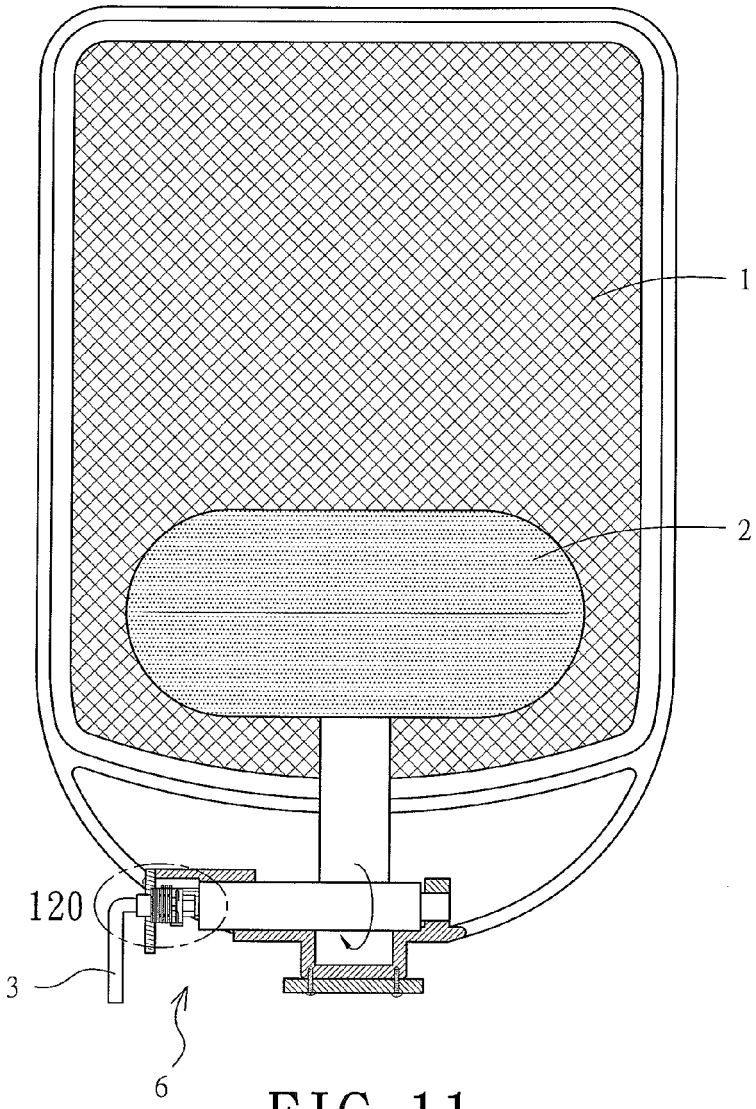
FIG. 11 is a partially sectional front view showing the lumbar support assembly of the present invention being adjusted.
Figure 14:
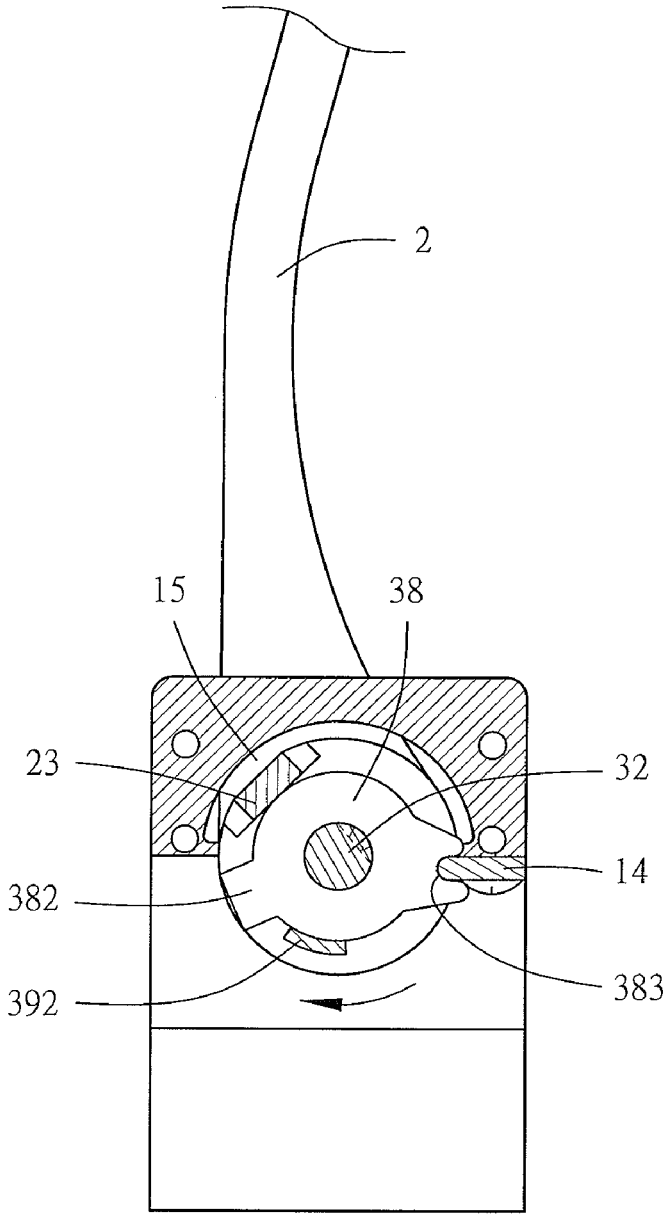
FIG. 14 is a sectional view taken along the line 140-140 in FIG. 12.

Forward or backward adjustment of the lumbar support assembly 6 (see FIGS. 1 and 5) is carried out in the following manner. The pulling rod 3 is pulled backward (see FIGS. 10 and 11) so that the projections on the corresponding surfaces of the positioning element 38 and the moving element 39 are pressed against each other, thereby bringing the lumbar support 2 into the free state (see FIG. 12). As the hole 361 at one end of each rotating element 36 is controlled by the control portion 23 extending from the corresponding bar section 22 at the lower end of the lumbar support 2 (see FIG. 13), and the slot 351, 383 at one end of each engaging element 35 and of each positioning element 38 is retained by the stopper plate 14 provided at the bottom of one lateral portion of the base 11, only the rotating elements 36 and the moving element 39 will rotate with the pulling rod 3 when the pulling rod 3 is moved. This allows the lumbar support 2 to be manually adjusted to the desired angle (see FIG. 14). Once the lumbar support 2 has been adjusted to the desired position, the pulling rod 3 is pushed back to its original position (see FIG. 5) to bring the lumbar support 2 into the locked state in which the projections and recesses on the corresponding surfaces of the positioning element 38 and the moving element 39 are engaged with each other. Thus, the lumbar support assembly 6 can be adjusted forward or backward with simple actions and provide optimal support and comfort.

What is claimed is:

1. An adjustable lumbar support assembly provided on a front side of a chair, the lumbar support assembly comprising: a base formed at a lower end of a backrest of the chair, a lumbar support, and an angle adjustment assembly, wherein:

the base has two spaced lateral portions respectively and concavely provided with a groove and a through hole, and bar sections formed bilaterally at a lower end of the lumbar support are disposed in the groove and the through hole of the base respectively, wherein one said bar section is extended with a control portion;

the angle adjustment assembly comprises a pulling rod, the pulling rod having a flange inserted in a side panel, the side panel having an inner surface bilaterally formed with concave spaces for receiving an outer washer, the pulling rod further having a horizontal rod section adjacent to the flange, there being at least an engaging element and at least a rotating element mounted alternately around the horizontal rod section, the pulling rod further having a threaded rod section adjacent to the horizontal rod section, the threaded rod section having a flat surface on one side, there being a positioning element and a moving element mounted around the threaded rod section, the positioning element having a surface formed with alternately arranged projections and recesses, the moving element having a surface which corresponds in position to the surface of the positioning element and is formed with alternately arranged projections and recesses, wherein the lumbar support is in a locked state when the projections and the recesses on the corresponding surfaces of the positioning element and the moving element are engaged with each other, and in a free state when the projections on the corresponding surfaces of the positioning element and the moving element are pressed against each other, the threaded rod section having a distal end fastened with a screw nut for position limiting purposes;

each said rotating element has an end formed with a hole through which the control portion extending from the one said bar section at the lower end of the lumbar support passes, and each said engaging element has an end formed with a slot with which a stopper plate is engaged, the stopper plate being installed at a bottom of a corresponding said lateral portion of the base, the pulling rod further having a rod section which extends from the threaded rod section and is inserted in a hole in a corresponding said bar section of the lumbar support, the side panel being disposed at a relatively outer position of the pulling rod, pressed against a corresponding said lateral portion of the base, and fixed in position by a plurality of threaded fasteners, wherein the bar section of the lumbar section that faces away from the pulling rod is covered with a covering element and limited in position by a threaded fastener; and forward or backward adjustment of the lumbar support assembly is made by pulling the pulling rod backward so that the lumbar support enters the free state in which the projections on the corresponding surfaces of the positioning element and the moving element are pressed against each other to allow manual adjustment of the lumbar support to a desired position, and when the pulling rod is pushed back in position, the lumbar support enters the locked state in which the projections and the recesses on the corresponding surfaces of the positioning element and the moving element are engaged with each other, the lumbar support assembly thus featuring easy adjustment for optimal support and comfort.

2. The adjustable lumbar support assembly of claim 1, further comprising at least a washer which is mounted around the horizontal rod section of the pulling rod and is located between the outer washer and the at least an engaging element so as to enable flexible adjustment of forward/backward rotation of the lumbar support assembly.

3. The adjustable lumbar support assembly of claim 1, wherein the positioning element has an end formed with a projection, and the moving element has a predetermined peripheral section formed with a bent portion extending toward the positioning element so as to limit rotation of the pulling rod when the pulling rod is pulled backward.

4. The adjustable lumbar support assembly of claim 1, wherein the base has a lateral side on which the through hole is concavely provided and which has a cavity formed along a rim of the through hole so that, when activated, the positioning element and the moving element mounted around the pulling rod can move in the cavity.

5. The adjustable lumbar support assembly of claim 1, wherein the screw nut fastened to the threaded rod section of the pulling rod is internally provided with an anti-loosening washer so that the at least an engaging element and the at least a rotating element mounted around the horizontal rod section of the pulling rod are kept closely packed.

* * * * *